United States Patent [19]

Namnath

[11] Patent Number: 4,536,183

[45] Date of Patent: Aug. 20, 1985

[54] MANGANESE BLEACH ACTIVATORS

[75] Inventor: James S. Namnath, Bergenfield, N.J.

[73] Assignee: Lever Brothers Company, New York, N.Y.

[21] Appl. No.: 597,971

[22] Filed: Apr. 9, 1984

[51] Int. Cl.[3] ..... C11D 3/39; C11D 7/18

[52] U.S. Cl. ..... 8/107; 252/95; 252/186.27; 252/186.3; 252/186.33; 252/186.43; 252/99; 252/186.41

[58] Field of Search ..... 8/107; 252/186.27, 186.3, 252/186.33

[56] References Cited

U.S. PATENT DOCUMENTS

| | | | |
|---|---|---|---|
| 3,156,654 | 11/1964 | Konecny et al. | 252/95 |
| 3,325,397 | 6/1967 | Plank et al. | 208/120 |
| 3,398,096 | 8/1968 | Das et al. | 252/95 |
| 3,488,288 | 1/1970 | Hill | 252/99 |
| 3,532,634 | 10/1970 | Woods | 252/95 |
| 4,207,199 | 6/1980 | Perner et al. | 252/174.13 |
| 4,208,295 | 6/1980 | Sai et al. | 252/99 |
| 4,247,731 | 1/1981 | Wunder et al. | 585/640 |
| 4,307,010 | 12/1981 | Sandler et al. | 260/42.47 |
| 4,478,733 | 10/1984 | Oakes | 252/99 |
| 4,481,129 | 11/1984 | Oakes | 252/186.41 |
| 4,488,980 | 12/1984 | Oakes | 252/99 |

FOREIGN PATENT DOCUMENTS

| | | |
|---|---|---|
| 25608 | 3/1981 | European Pat. Off. . |
| 70079 | 1/1983 | European Pat. Off. . |
| 72166 | 2/1983 | European Pat. Off. . |
| 82563 | 6/1983 | European Pat. Off. . |

OTHER PUBLICATIONS

"Transition Metal Ions on Molecular Sieves, II. Catalytic Activities of Transition Metal Ions on Molecular Sieves for the Decomposition of Hydrogen Peroxide", by Mochida et al., J. Phys. Chem., 78, pp. 1653–1657, (1974).

*Primary Examiner*—A. Lionel Clingman

*Attorney, Agent, or Firm*—Milton L. Honig; James J. Farrell

[57] ABSTRACT

A catalyst for the controlled decomposition of peroxy compounds is provided which comprises a water-soluble manganese (II) salt adsorbed onto a solid inorganic silicon support material, the combination having been prepared at a pH from 7.0 to 11.1.

27 Claims, No Drawings

MANGANESE BLEACH ACTIVATORS

BACKGROUND OF THE INVENTION

1. Field of the Invention

The invention relates to a bleach activator, processes for its preparation and dry bleaching powders incorporating this activator.

2. The Prior Art

Dry bleaching powders for cleaning laundry generally contain inorganic persalts as the active component. These persalts serve as a source of hydrogen peroxide. In the absence of an activator, persalt bleach activity is undetectable where temperatures are less than 100° F. and delivery dosages less than 100 ppm active oxygen. Activators have been recognized in the art as a method for effectuating bleaching under mild conditions.

U.S. Pat. No. 3,156,654 discloses heavy metal ions such as cobalt in combination with a chelating agent to catalyze peroxide decomposition. U.S. Pat. No. 3,532,634 suggests as effective persalt activators transition metals having atomic number 24 to 29 alongside a chelating agent. Neither process is totally satisfactory. Bare metal ions, even when chelated, accelerate wasteful decomposition reactions that are non-bleach effective. Under alkaline conditions, such as in laundry cleaning compositions, metal ions undergo irreversible oxidation. Perversely, the peroxide bleaching reaction is most effective at high pH. Another concern with soluble metal ion systems is the potential for ion deposition onto the fabric. Discoloration of fabric can occur where deposited metal ions undergo subsequent oxidation. Finally, the prior art metal ion catalysts are sensitive to water hardness. Their activity varies with the calcium and magnesium content of the water source.

Manganese (II) has been reported to be exceptionally effective in activating persalts under mild conditions. European Patent Application No. 0 082 563 discloses bleach compositions containing manganese (II) in conjunction with carbonate compounds. British Patent Application No. 82 36,005 describes manganese (II) in conjunction with a condensed phosphate/orthophosphate and an aluminosilicate as a bleach activator system. European Patent Application No. 0 025 608 reveals a peroxide decomposition catalyst consisting of acid treated zeolites or silicates whose cations have been exchanged for heavy metals such as manganese.

All the aforementioned activator systems still suffer from the presence of soluble manganese (II) ions. The soluble ions deposit on fabrics. Strong oxidants, such as hypochlorites, are frequently included in laundry washes. Deposited manganese will react to form highly staining manganese dioxide.

Consequently, it is an object of the present invention to provide a persalt manganese bleach activator that will not result in laundry staining.

A further object of this invention is to provide a process for the preparation of the manganese bleach activator.

Another object of this invention is to provide a laundry bleaching composition.

SUMMARY OF THE INVENTION

A catalyst for the controlled decomposition of peroxy compounds is provided comprising a water-soluble manganese (II) salt adsorbed onto a solid inorganic silicon support material, the combination having been prepared at a pH from 7.0 to 11.1.

Furthermore, a process for the preparation of a catalyst for the controlled decomposition of peroxy compounds is disclosed comprising:

(a) dissolving a water-soluble manganese (II) salt and a solid silicon support material in a solvent, the ratio of manganese (II) to solid silicon support material ranging from 1:1000 to 1:10;
(b) adjusting pH to achieve a value from 7.0 to 11.1;
(c) separating the solid composition;
(d) washing the solid composition with solvent to remove any traces of free manganese (II) salts; and
(e) drying the solid composition to remove solvent and mositure.

An alternate process for the preparation of the above catalyst, where the amount of manganese (II) does not exceed the adsorptive capacity of the solid silicon support material, involves dissolving a water soluble manganese (II) salt and a solid silicon support material in a solvent and subsequently spray-drying the slurry.

DETAILED DESCRIPTION OF THE INVENTION

It has been found that by binding water-soluble manganese (II) ions onto an insoluble solid support, free manganese dioxide will not subsequently form. Fabric staining problems are thereby overcome. To achieve this result, the catalyst must be prepared in the manner herein prescribed. The resultant catalyst will (1) not release free manganese ions into the wash solution during use; (2) possess acceptable activity; and (3) have a satisfactory physical appearance.

In the method of catalyst preparation, the key parameter is control of pH during the adsorption of manganese onto the solid support material. Manganese adsorption increases dramatically with increased pH. The pH may range from 7.0 to 11.1. Preferably, adsorption should take place between pH 8.0 and 10.5; at pH above 10.5 the resultant catalyst begins to develop an unpleasant brown appearance.

Finished catalysts may be recovered in various ways subsequent to equilibration of solid support with manganese solution. Simple filtration of solids is one separation method. Copious quantities of fresh water or alcohol solvent must be used to wash the solid catalyst. The washing step is critical. Loosely bound or free manganese is thereby eliminated preventing microcrystalline manganese (II) salts from forming. Drying is necessary to eliminate bound water from the solid material. Removal of water is accomplished by drying between 100° C. and 250° C. Bound water can affect storage stability of the persalt-catalyst combination. Water content must be kept below 10 % in the final catalyst.

Another method of preparation is blending manganese and the support material using an amount of manganese salt which does not exceed the adsorptive capacity of the solid. After adsorption, the content of free manganese salt in solution will be negligible. Removal of water is here most easily accomplished by spray-drying the slurry.

The manganese used in the present invention can be derived from any manganese (II) salt which delivers manganous (II) ions in aqueous solution. Manganous sulfate and manganous chloride or complexes thereof such as manganous triacetate are examples of such suitable salts.

The solid inorganic silicon support material has but one requirement—a capacity for manganous (II) adsorption greater than 0.1 weight %. Suitable solid materials encompass the aluminosilicates, including the synthetically formed variety known as zeolites, the silicates, silica gels and aluminas. Among the silicates, magnesium silicate is preferred; this material is sold by the Floridin Corp. under the trademark Florisil TM.

Clays may also be suitable substrates. Two varieties of clay materials which function in the instant composition are geologically known as smectites (or montmorillonoides) and attapulgites (or palygorskites). Smectites are three-layered clays. There are two distinct classes of smectite-type clays. The first contains aluminum oxide, the second has magnesium oxide present in the silicate crystal lattice. General formulas for these smectites are $Al_2(Si_2O_5)_2(OH)_2$ and $Mg_3(Si_2O_5)(OH)_2$, covering the aluminum and magnesium oxide type clays, respectively. Commercially available smectite clays include, for example, montmorillonite (bentonite), volchonskoite, nontronite, beidellite, hectorite, saponite, sauconite and vermiculite. Attapulgites are mangesium-rich clays having principles of superposition of tetrahedral and octahedral unit cell elements different from the smectities. An idealized composition of the attapulgite unit cell is given as: $(OH_2)_4(OH)_2Mg_5Si_8O_{20}.4H_2O$.

Zeolites are the preferred support materials. Many commercial zeolites have been specifically designed for use in laundering applications. Accordingly, they exhibit the favorable properties of dispersivity in wash solution. Moreover, their tendency for being entrapped by fabrics is low. Synthetic zeolites are preferred over the natural ones. The latter have an appreciable content of extraneous metal ions that may promote wasteful peroxide decomposition reactions.

Finished catalyst will contain from about 0.1% to about 5.5% manganese (II) per weight of solid support. Preferably, the amount of manganese (II) is from about 1to about 2.5%.

These peroxy compound activators are incorporated into laundry bleach compositions. Besides activator, these compositions comprise a peroxide source and phosphate stabilizer. Suitable peroxy compounds include the inorganic persalts which liberate hydrogen peroxide in aqueous solution. These include water-soluble perborates, percarbonates, perphosphates, persilicates, persulfates and organic peroxides. Amounts of peroxy compound in the dry bleach powder should range from about 5 to about 30%. At least 30 ppm active oxygen should be delivered by the persalt. For instance, with sodium perborate monohydrate, this represents a minimum amount of 200 mg per liter of wash solution.

The catalyst should deliver a miniumum level of 0.5 ppm manganese to the wash. For instance, if a catalyst has 1 weight % of manganese then at least 5 grams catalyst per liter of wash solution is required.

Phosphate stabilizers are suggested for combination with the dry bleach powders. Suitable stabilizers include the alkali metal salts of tripolyphosphate, orthophosphate and pyrophosphate. Amounts of phosphate stabilizer should range from about 5% to about 35 %. Preferably, they should be present from about 10% to 15%.

Surface active detergents may be present in an amount from about 2% to 50% by weight, preferably from 5% to 30% by weight. These surface active agents may be anionic, nonionic, zwitterionic, amphoteric, cationic or mixtures thereof.

Among the anionic surfactants are water-soluble salts of alkylbenzene sulfonates, alkyl sulfates, alkyl ether sulfates, paraffin sulfonates, α-olefin sulfonates, α-sulphocarboxylates and their esters, alkyl glycerol ether sulfonates, fatty acid monoglyceride sulfates and sulfonates, alkyl phenol polyethoxy ether sulfates, 2-acyloxy-alkane-1-sulfonates and β-alkoxyalkane sulfonates. Soaps are also preferred anionic surfactants.

Nonionic surfactants are water-soluble compounds produced by the condensation of ethylene oxide with a hydrophobic compound such as alcohol, alkyl phenol, polypropoxy glycol or polypropoxy ethylene diamine.

Cationic surface active agents include the quaternary ammonium compounds having 1 or 2 hydrophobic groups with 8–20 carbon atoms, e.g., cetyl trimethylammonium bromide or chloride, dioctadecyl dimethylammonium chloride, and the fatty alkyl amines.

A further exposition of suitable surfactants for the present invention appears in "Surface Active Agents and Detergents", by Schwartz, Perry & Berch (Interscience, 1958), the disclosure of which is incorporated herein by reference.

Detergent builders may be combined with the bleach compositions. Useful builders can include any of the conventional inorganic and organic water-soluble builder salts.

Typical of the well known inorganic builders are the sodium and potassium salts of the following: pyrophosphate, tripolyphosphate, orthophosphate, carbonate, bicarbonate, silicate, sesquicarbonate, borate and aluminosilicate.

Among the organic detergent builders that can be used in the present invention are the sodium and potassium salts of citric acid and nitrilotriacetic acid.

These builders can be used in an amount from 0 up to about 80% by weight of the composition, preferably from 10% to 50% by weight.

Apart from detergent active compounds and builders, compositions of the present invention can contain all manner of minor additives commonly found in laundering or cleaning compositions in amounts in which such additives are normally employed. Examples of these additives include: lather boosters, such as alkanolamides, particularly the monoethanolamides derived from palm kernel fatty acids and coconut fatty acids; lather depressants, such as alkyl phosphates, waxes and silicones; fabric softening agents; fillers; and usually present in very minor amounts, fabric whitening agents, perfumes, enzymes, germicides and colorants.

The following examples will more fully illustrate the embodiments of the invention. All parts, percentages and proportions referred to herein and in the appended claims are by weight unless otherwise indicated.

EXAMPLE 1

Catalyst Preparation

A total of 2.5 grams of manganous chloride tetrahydrate was dissolved in 50 ml of distilled water. A separate vessel was charged with a slurry of 50 grams zeolite (Union Carbide ZB-300) and 250 ml of water. The slurry pH was adjusted with either sodium hydroxide or hydrochloric acid solutions to the appropriate pH (see Table I). Zeolite slurry and manganous chloride solution were combined and stirred for at least 20 minutes.

The solid was then filtered, washed with water, and dried at 110° C. for 12 hours.

EXAMPLE 2

A bleach composition was formulated comprising:

| Component | Weight (grams) |
|---|---|
| Sodium perborate monohydrate | 0.45 |
| Sodium tripolyphosphate | 0.20 |
| Sodium carbonate | 0.30 |
| Sodium pyrophosphate | 0.10 |
| Sodium linear $C_{10}$–$C_{15}$ alkylbenzene sulfonate | 0.20 |
| Example 1 catalyst | — |

Bleaching tests were conducted with a 4 pot tergotometer from the U.S. Testing Company. Wash solutions were prepared from distilled water with hardness ions added to provide 80 ppm calcium and 40 ppm magnesium. Sodium hydroxide was used to elevate the pre-wash pH to about 10.9. The wash volume was 1 liter. Temperature was maintained at 40° C. Agitation was provided throughout the 14 minute wash period.

Bleaching was monitored by measuring reflectance of a dry cotton cloth (4"×6"). Prior to bleaching, the cloth had been uniformly stained with a tea solution and washed several times in a commercial detergent. Reflectance was measured on a Gardner XL-23 reflectometer.

To the aforementioned bleach composition were added varying amounts of bleach catalyst having been prepared at various pH levels as outlined in Table I below. Higher reflectance changes signify greater bleach effectiveness.

TABLE I

Effect of Catalyst Preparation and Concentration

| pH of Zeolite Slurry | Catalyst Amount, gm. | Reflectance Change |
|---|---|---|
| 5.0 | 0 | 2.8 |
| 5.0 | 0.05 | 3.5 |
| 5.0 | 0.10 | 3.7 |
| 5.0 | 0.15 | 4.4 |
| 7.0 | 0 | 2.15 |
| 7.0 | 0.05 | 8.82 |
| 7.0 | 0.10 | 11.54 |
| 7.0 | 0.15 | 12.97 |
| 9.0 | 0 | 3.03 |
| 9.0 | 0.05 | 10.07 |
| 9.0 | 0.10 | 11.70 |
| 9.0 | 0.15 | 12.28 |

Where catalyst was prepared at pH 5, the bleach activity was quite poor as seen in the low reflectance numbers. Catalysts prepared at pH 7 and above, however, demonstrated a significant increase in bleach activity.

EXAMPLE 3

Inorganic phosphates stabilize the bleach compositions of the present invention. A base composition was prepared comprising 0.35 grams of sodium perborate monohydrate and 0.08 grams of a 1.5% manganese on zeolite catalyst (Union Carbide's ZB-100). In preparing the catalyst, the zeolite was treated with sodium hydroxide to obtain a solution pH of 10.7. Various amounts sodium tripolyphosphate were blended with the base composition. Tea stained swatches were bleached with these compositions in a tergotometer. Bleach effectiveness was measured by the swatch reflectance changes. These results are recorded in Table II.

TABLE II

| Sodium Tripolyphosphate (g) | Reflectance Change |
|---|---|
| 0 | 1.75 |
| 0.05 | 4.58 |
| 0.10 | 6.32 |
| 0.15 | 6.29 |
| 0.20 | 6.07 |
| 0.30 | 5.18 |
| 0.40 | 1.80 |

From Table II it appears that sodium tripolyphosphate present from 0.05 to 0.30 grams per liter wash solution stabilized the bleach reactions.

EXAMPLE 4

This example illustrates the effectiveness of catalysts incorporating metal ions other than manganese on solid silicon support materials. According to this invention, metal ions were adsorbed onto zeolite (Union Carbide ZB-400). They were prepared in a fashion similar to that described in Example 1. These catalysts were blended into a bleach composition composed of:

| Components | Weight (grams) |
|---|---|
| Sodium perborate monohydrate | 0.4 |
| Sodium carbonate | 0.4 |
| Sodium tripolyphosphate | 0.3 |
| Linear $C_{10}$–$C_{15}$ alkylbenzene sulfonate | 0.2 |
| Catalyst | 0.1 |

p The wash solutions for this composition contained 80 ppm calcium and 40 ppm magnesium. Sodium hydroxide was used to raise the pH of the wash solution to 10.7. Table III outlines the effectiveness of various metal ions. Manganese (II) was found to be far superior to cobalt, copper and iron impregnated zeolite.

TABLE III

| Metal Ion | Reflectance Change |
|---|---|
| Cobalt (II) | 1.90 |
| Copper (II) | −4.0 |
| Iron (III) | −2.7 |
| Manganese (II) | 10.7 |

The foregoing description and examples illustrate selected embodiments of the present invention and in light thereof variations and modifications will be suggested to one skilled in the art, all of which are in the spirit and purview of this invention.

What is claimed is:

1. A catalyst for the controlled decomposition of peroxy compounds comprising a water-soluble manganese (II) salt adsorbed onto a solid inorganic silicon support material, wherein the ratio of manganese (II) to inorganic silicon support material ranges from 1:1000 to 1:10, the combination having been prepared at a pH from 7.0 to 11.1 and where the amount of manganese (II) does not exceed the adsorptive capacity of the inorganic silicon or alumina support material.

2. A catalyst according to claim 1 wherein the inorganic silicon support material is a zeolite.

3. A catalyst according to claim 1 wherein the inorganic silicon support material is a magnesium silicate.

4. A catalyst according to claim 1 wherein the inorganic silicon support material is silica gel.

5. A catalyst according to claim 1 wherein the inorganic silicon support material is a smectite or attapulgite clay.

6. A catalyst according to claim 1 wherein the peroxy compound is a sodium perborate salt.

7. A process for preparation of a catalyst for the controlled decomposition of peroxy compounds comprising:

(a) combining a water-soluble manganese (II) salt dissolved in a solvent and slurry of a solid silicon or alumina support material in a solvent, the ratio of manganese (II) to solid silicon or alumina support material ranging from 1:1000 to 1:10;

(b) adjusting pH to achieve a value from 7.0 to 11.1;

(c) separating the solid composition;

(d) washing the solid composition with solvent to remove any traces of free manganese (II) salts; and (e) drying the solid composition to remove solvent and moisture.

8. A process according to claim 7 wherein the solid silicon support material is a zeolite.

9. A process according to claim 7 wherein the solid silicon support material is a magnesium silicate.

10. A process according to claim 7 wherein the solid silicon support material is silica gel.

11. A process according to claim 7 wherein the solid silicon support material is a smectite or attapulgite clay.

12. A process according to claim 7 wherein the peroxy compound is a sodium perborate salt.

13. A process according to claim 7 wherein the solvent is water, an alcohol or mixtures thereof.

14. A process for prepartion of a catalyst for the controlled decomposition of peroxy compounds comprising:

(a) combining a water-soluble manganese (II) salt dissolved in a solvent and slurry of a solid silicon or alumina support material in a solvent, the manganese (II) being present in an amount that does not exceed the adsorptive capacity of the solid support material;

(b) adjusting pH to achieve a value from 7.0 to 11.1; and (c) spray-drying the resultant slurry.

15. A process according to claim 14 wherein the solid silicon support material is a zeolite.

16. A process according to claim 14 wherein the solid silicon support material is a magnesium silicate.

17. A process according to claim 14 wherein the solid silicon support material is silica gel.

18. A process according to claim 14 wherein the solid silicon support material is a smectite or attapulgite clay.

19. A process according to claim 14 wherein the peroxy compound is a sodium perborate salt.

20. A process according to claim 14 wherein the solvent is water, an alcohol or mixtures thereof.

21. A laundry bleaching composition comprising:

(a) a catalyst according to claim 1; and (b) a peroxy compound, wherein the ratio of catalyst to peroxy compound ranges from 1:100 to 100:1.

22. A laundry bleaching composition according to claim 21 further comprising an inorganic phosphate salt stabilizer.

23. A laundry bleaching composition according to claim 22 wherein the phosphate stabilizer is chosen from the group consisting of tripolyphosphate, orthophosphate, pyrophosphate and mixtures thereof.

24. A method for bleaching a fabric comprising placing the fabric into water and treating with a composition comprising:

(a) a catalyst according to claim 1 which delivers at least 0.5 ppm manganese (II) per liter wash solution; and (b) a peroxy compound present in an amount to deliver at least 200 mg per liter to the wash solution.

25. A method according to claim 24 further comprising an inorganic phosphate salt stabilizer present in an amount to deliver from about 0.05 to 0.30 grams per liter wash solution.

26. A method according to claim 25 wherein the phosphate salt is selected from the group consisting of tripolyphosphate, orthophosphate, pyrophosphate and mixtures thereof.

27. A method according to claim 24 wherein the peroxy compound is a sodium perborate salt.

* * * * *